US006283295B1

(12) United States Patent
Akutagawa et al.

(10) Patent No.: US 6,283,295 B1
(45) Date of Patent: Sep. 4, 2001

(54) CONTAINER WITH ELEVATING FLOOR

(76) Inventors: Donald Akutagawa; Terry Whitman, both of PMB - 175, 15600 NE. 8th St., B-1, Bellevue, WA (US) 98008-3917

( * ) Notice: Subject to any disclaimer, the term of this patent is extended or adjusted under 35 U.S.C. 154(b) by 0 days.

(21) Appl. No.: 09/557,683

(22) Filed: Apr. 25, 2000

(51) Int. Cl.[7] ..... B65D 73/00

(52) U.S. Cl. ..... 206/494; 206/233; 206/761; 221/52; 221/56; 229/185

(58) Field of Search ..... 206/494, 499, 206/233, 555, 556, 761–763, 765, 738, 817; 221/48, 52, 56, 57, 62; 229/185

(56) References Cited

U.S. PATENT DOCUMENTS

| | | | | |
|---|---|---|---|---|
| 772,381 | * | 10/1904 | Seegmiller | 229/185 |
| 2,087,181 | | 7/1937 | Conway . | |
| 2,237,424 | | 4/1941 | Hope . | |
| 2,253,742 | | 8/1941 | West et al. . | |
| 2,307,146 | * | 1/1943 | McCash et al. | 206/761 |
| 2,347,823 | | 5/1944 | Goodman et al. . | |
| 2,636,599 | * | 4/1953 | Willis et al. | 221/48 |
| 3,202,316 | | 8/1965 | Silver . | |
| 3,603,452 | * | 9/1971 | Singer | 206/494 |
| 3,647,114 | | 3/1972 | Bleuer . | |
| 3,826,407 | | 7/1974 | Keating . | |
| 3,942,682 | * | 3/1976 | McKay | 206/494 |
| 4,185,753 | | 1/1980 | Ramsey . | |
| 4,238,068 | | 12/1980 | Ellerbe et al. . | |
| 4,279,379 | * | 7/1981 | Lohrbach et al. | 229/185 |
| 4,616,767 | | 10/1986 | Seido . | |
| 5,065,935 | | 11/1991 | Mancel . | |
| 5,065,936 | | 11/1991 | King . | |
| 5,165,570 | | 11/1992 | Windorski et al. . | |
| 5,197,631 | * | 3/1993 | Mishima | 221/56 |
| 5,390,820 | | 2/1995 | Wright et al. . | |
| 5,979,699 | | 11/1999 | Simpson . | |
| 5,979,700 | * | 11/1999 | Suess | 221/56 |

OTHER PUBLICATIONS

Rite–Aid Facial Tissue Dispenser.

* cited by examiner

*Primary Examiner*—Luan K. Bui
(74) *Attorney, Agent, or Firm*—Graybeal Jackson Haley LLP

(57) ABSTRACT

An improved container for dispensing facial tissues, sheet materials or bulk products using an elevating panel and a bracing panel, generally opposed to one another, and a pair of support panels generally opposed to one another. A tab is present in the bracing panel and is receivable by the elevating panel. Upon a user urging the floor towards the top of the container, the tab engages the slot to form a stable structure wherein the support panels rest on the elevating and bracing panels. A floating panel may be placed in the container to provide a more planar floor for certain applications. Also disclosed is a multifaceted container wherein each floor panel has both tabs and slots and are arranged in a fan-like manner. Each tab then engages an adjacent slot formed in an adjacent panel to accomplish the elevated floor upon user biasing actions.

16 Claims, 8 Drawing Sheets

CONTAINER WITH ELEVATING FLOOR

FIELD OF THE INVENTION

The present invention relates to a dispensing device, or container, for facial tissues, other flexible sheet materials, or bulk products, and, more particularly to an elevating floor for a dispensing device to permit easier access to the contents after a portion of the contents have been removed. A specific application is presented wherein the floor of a facial tissue box is elevate-able to enhance access to the tissues remaining in the box after a quantity has been removed.

BACKGROUND OF THE INVENTION

Regular sized containers or boxes of facial tissues, typically of a rectangular shape, present little or no difficulty in their use. The boxes have generally four side walls, a bottom portion and a top portion. The top portion usually has a relatively large aperture having a sheet of plastic material extending over the aperture with a slit formed therein. The tissue product in the box is in the form of an interleaved stack of tissues, known in the art as a "clip." Tissues are then extended through the slit and frictionally held therein. The interleaving of tissues within the box causes successive tissues to feed through the top slit one at a time until the last tissue is used. Larger boxes of tissues with additional depth, or generally cubical boxes, however, present certain difficulties. The larger boxes, which can be nearly twice the height of the regular size, work like the regular size for the first portion of the tissues. After that, the depth of the box results in a greater distance of the tissue supply from the dispensing aperture at the top. This distance tends to allow the lead tissue to fall free of the dispensing aperture, back into the box, because the tissue-to-tissue friction between the leading and trailing tissues is insufficient to overcome frictional resistance and/or gravity acting on the trailing tissue. Hence, the user is inconveniently required to retrieve the lead sheet and put it back into place at the top. The problem is compounded because it is more difficult to grasp a single tissue than several, after which the lead tissue must be carefully selected and threaded through the top aperture. The retrieval procedure is often repeated as subsequent tissues continue to fall out of the aperture. The repeated retrievals often result in tearing of the plastic sheeting containing the aperture, thus rendering it unusable as intended. Furthermore, repeated retrievals expose the remaining tissues to external contamination.

The problem presented by cubical shaped boxes is twofold. First, the clip of interleaved tissues is arranged in an inverted U-shape. This shape gives rise to a high level of friction between a large portion of the surface area of the lead tissue and the interior walls of the box, which makes the tissue difficult to pull out through the dispensing aperture and can lead to tearing of the tissue. Once this problem is alleviated, as by an alternative method of interleaving the clip, the problem remains of the lead tissue falling free of the dispensing aperture when the supply is diminished as described above.

Numerous efforts have been undertaken to address the stated problems. The devices in U.S. Pat. No. 3,942,682 to McKay, and U.S. Pat. No. 5,390,820 to Wright, utilize a platform of flexible material, supported by added extensions. U.S. Pat. No. 5,979,699 to Simpson requires two platforms and a styrene lifter. U.S. Pat. No. 5,979,700 to Seuss uses a bendable sheet of cardboard under the tissues which bend is increased by one or more rubber bands. These devices keep the top tissue pushed toward the top of the container, enhancing successive sheet feed through the top opening. These inventions, however, are complicated and entail numerous steps in manufacturing and use.

U.S. Pat. No. 4,185,753 to Leto, U.S. Pat. No. 2,087,181 to Conway, U.S. Pat. No. 2,347,823 to Goodman, and U.S. Pat. No. 3,826,407 to Keating pertain to devices used in wrist bracelets for dispensing cosmetic sheets. The devices of Conway and Goodman require a spring means to move available sheets toward the discharge opening. In the Conway device, before use, the sheets must be loaded into a dispenser opposite the end of the discharge slot.

U.S. Pat. No. 2,253,742 to West has two spring activated follower plates beneath the tissue clip. U.S. Pat. No. 2,237,424 to Hope and U.S. Pat. No. 5,165,570 to Windorski uses a coiled spring to lift the tissues. These inventions require additions to a container which make for more complexity and more expense during manufacture.

U.S. Pat. No. 5,065,935 to King, offers a collapsible box designed to make all tissues accessible, by crushing the sides and the corners of the box, thereby making the interior space smaller. This invention requires considerable effort on the part of the user to crush the four sides and the four corners.

U.S. Pat. No. 3,202,316 to Silver, U.S. Pat. No. 3,647,114 to Bleuer and U.S. Pat. No. 4,616,767 to Seido use elastic strips to elevate the stack of tissues. These dispensers have the disadvantage of difficulty in manufacture by requiring the addition of the elastic strips, and the added difficulty of installing the clip of tissues over the elastic.

U.S. Pat. No. 4,238,068 to Ellerbe, et. al. provides for an elevating mechanism that involves two "Major" and two "Minor" side panels which are designed to be folded twice to decrease the depth of the container two levels. In addition, open ends of the container require additional "Closure Flaps," to close open ends of the "tubular" container. This invention is complex and requires additional manufacturing procedures and expense.

In addition to the specific problems described in relation to retrieving facial tissues or similarly packaged sheet products, such as paper towels for drying hands or cleaning, an analogous problem exists in the packaging of some loose bulk products, like dog food for instance. Large sacks or boxes of bulk products present challenges for retrieval of the latter portions of the contents. For instance, large sacks of dog food are often deeper than an arm's length. It is inconvenient to grope around in the bottom of the sack while attempting to scoop up the remaining food. Some people go to the trouble of transferring the contents of the dog food sack to a smaller more convenient-to-use container. But, this approach requires additional storage space for the extra container, and invites spills when attempting the transfer from the large bag to the smaller container. Another, but not altogether safe solution, is to cut off the upper portion of the container or bag with a knife. Therefore, there is a need for a container with an elevatable floating floor panel that just fits the interior dimensions of the container such that when it is elevated the bulk contents therein are raised to a more convenient height for removal.

SUMMARY OF THE INVENTION

The present invention is directed to an improved container for dispensing flexible sheet materials, such as facial tissues, by providing for a physical container configuration of unitary design that elevates the internal floor of the container by means of convenient user manipulation. The container can be of conventional design, i.e., a top wall and four side walls, or can be of less conventional design, i.e., a top wall and a single, cylindrical side wall. In either case, the top wall defines an aperture for frictionally engaging at least one flexible sheet during operation of the container, and the invention concerns improvements to the bottom of the container, whether of conventional or non-conventional design. The floor of the container having the invention present therein comprises a plurality of, or at least two, bottom panels flexibly linked to one or more side walls designed to be biasable generally in an upward direction. A first panel is designated as an elevating panel and has a slot proximate to a distal edge thereof, wherein the proximal end is flexibly linked to the one or more side walls. A second panel is designated as a bracing panel and is located proximate to and below the elevating panel, and has a tab proximate to a distal edge thereof, wherein the proximal end is flexibly linked to the one or more side walls at a location generally opposite to the first panel linkage. When the panels are biased upwardly by a user, the tab of the bracing panel engages the slot of the elevating panel, thus generally locking or bracing the elevating panel in an upward position. Interleaved tissues, or other sheet products in the container, are thereby raised closer to the top of the container. In a preferred embodiment of the invention, two additional support panels, flexibly linked to the one or more of the side walls, are included in the set of floor panels. The support panels are positioned above the elevating and bracing panels to provide a broader based support for the product in the container when the panel set is biased upwardly. An alternative embodiment of the present invention utilizes a floating panel above the floor panel set to provide essentially planar support to loose bulk product contents in the container.

Alternative means of engaging the support and bracing panels are possible including the tab referred to above engaging a notch instead of a slot. Alternatively, an edge of the bracing panel can be made to adapt to a fold, crease or detent in the surface of the elevating panel.

The aforementioned means of engaging the panels are adaptable to containers having a plurality of overlapping bottom panels of similar size and shape where on each panel there is both a tab and a slot for example. The tab of a first panel would engage in a slot of a second adjacent panel while the slot on the first panel would engage with the tab of a third panel adjacent panel.

DETAILED DESCRIPTION OF THE INVENTION

The present invention generally applies to conventional large size generally rectangular facial tissue containers, and containers having a generally cubical shape, or having a generally square foot print.

Figure 1:
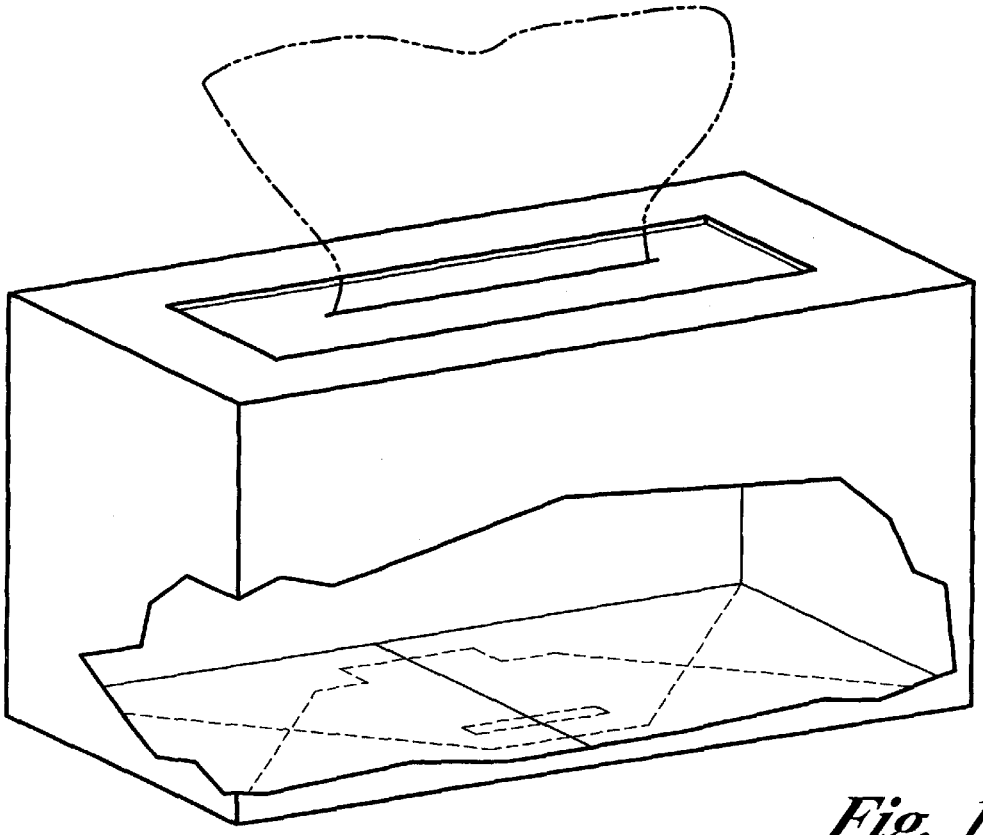
FIG. 1 is a perspective view of a generally rectangular embodiment of the invention showing the bottom panel set in their un-biased position.
Figure 2:
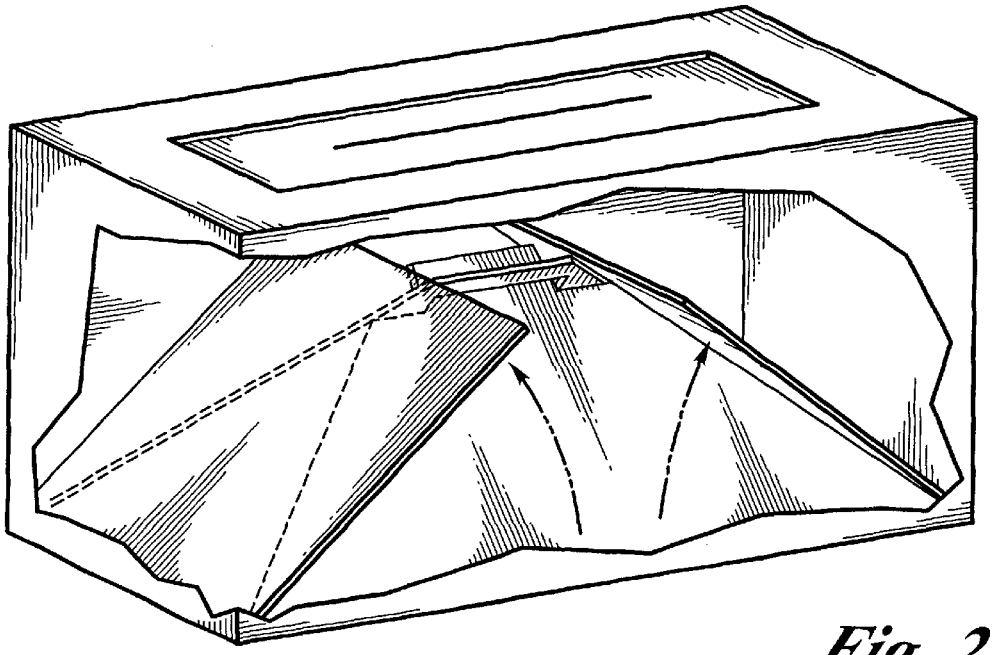
FIG. 2 is a perspective view of a generally rectangular embodiment of the invention showing the bottom panel set in their upwardly biased position.

FIG. 1 shows a top perspective view of a rectangular container 8 with a top panel 10 and a flexible membrane 12, typically constructed of clear plastic sheeting and defining a dispensing slot, or aperture, 14 through which a tissue is pulled and the remaining trailing tissue is frictionally held in place. The side and end panels of the container are conventional and well known. A bottom panel set comprising support panels 20 and 22, a bracing panel 40 (shown in phantom line), and an elevating panel 46 (also shown in phantom line) are shown through the cutaway portion in its un-biased position. FIG. 2 shows the container of FIG. 1 with the bottom panel set in its upwardly biased position.

Figure 3:
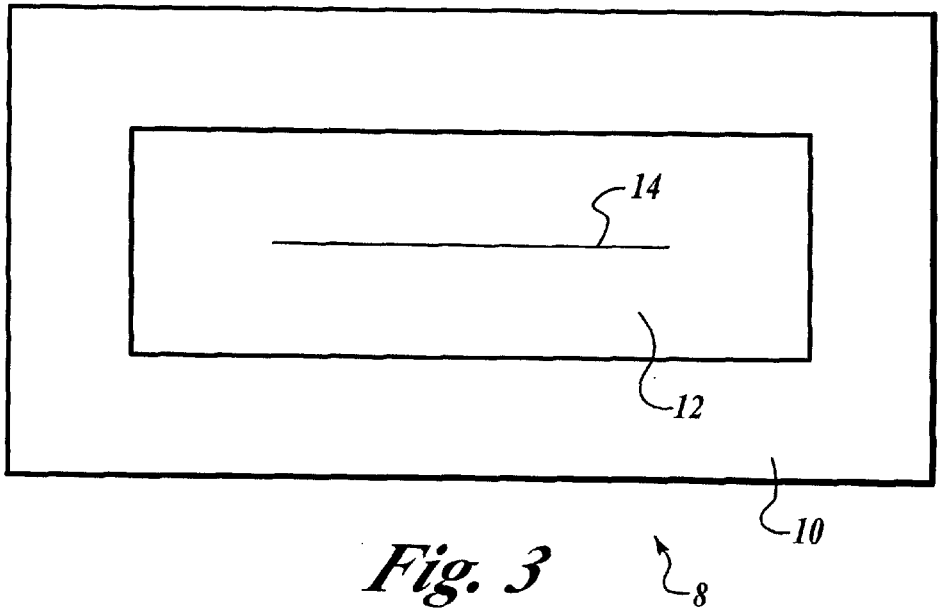
FIG. 3 is a top plan view of a first embodiment of the invention showing a container with a slot opening.
Figure 4:
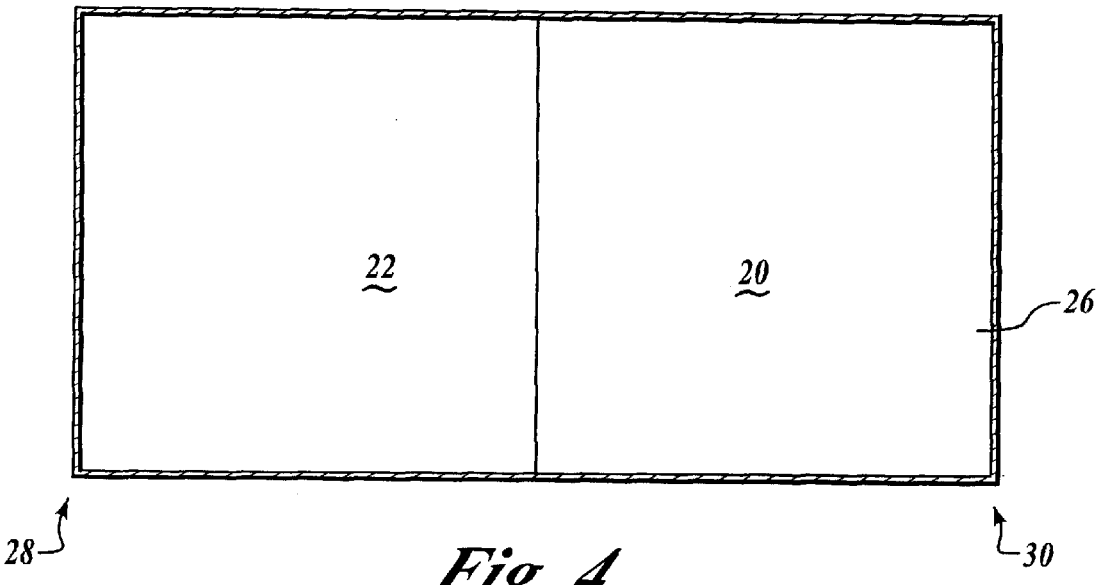
FIG. 4 is a bottom plan view of two bottom support panels present in the embodiment of FIG. 1.
Figure 5:
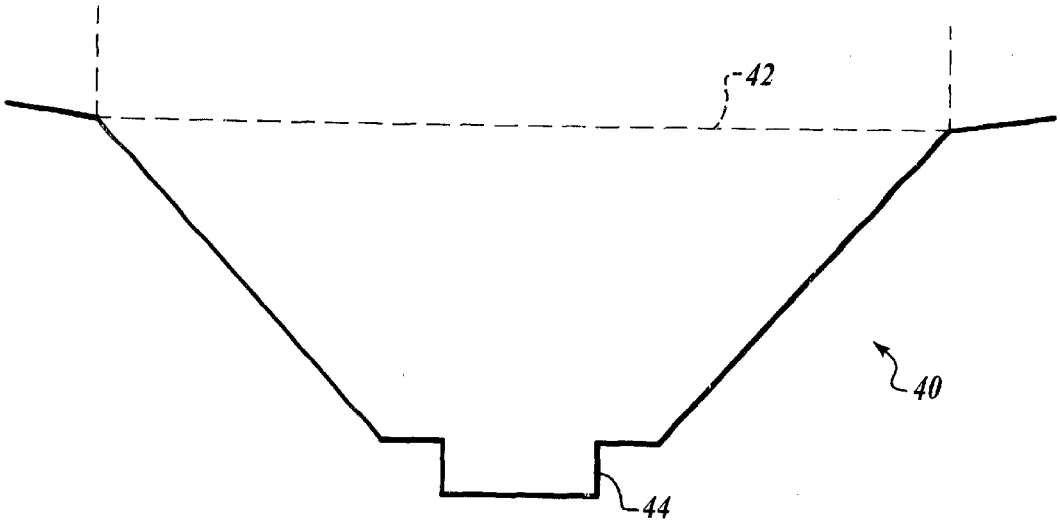
FIG. 5 is a plan view of a bracing panel for the embodiment of FIG. 1.
Figure 6:
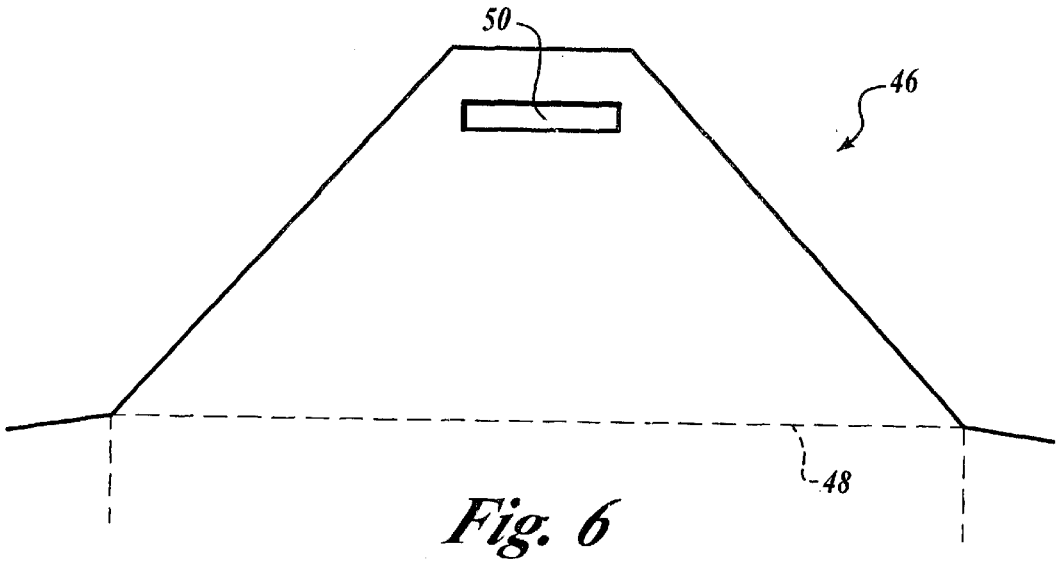
FIG. 6 is a plan view of an elevating panel for the embodiment of FIG. 1.

FIG. 3 shows a top view of a rectangular container 8 with a top panel 10 and a flexible membrane 12, typically constructed of clear plastic sheeting and defining a dispensing slot, or aperture, 14 through which a tissue is pulled and the remaining trailing tissue is frictionally held in place. The side and end panels of the container are conventional and well known in the art. The elevating floor of the container 8 is formed principally of a bottom panel set described as follows. FIG. 4 is a bottom view of the container 8 showing support flaps or panels 20 and 22. The support panels 20 and 22 are flexibly linked to end panels (not shown) along edges 28 and 30. FIG. 5 depicts a bracing panel 40. Edge 42, at a proximal end of the bracing panel 40, is flexibly linked to a side panel (not shown). Bracing panel 40 has an engagement means generally located proximate to the distal end, which, in a preferred embodiment, is a tab 44 as indicated in FIGS. 1, 2 and 5. FIG. 6 is a view of an elevating panel 46. Panel 46 is flexibly linked at a proximal end thereof to a side panel (not shown) along edge 48. Panel 46 has an engagement means generally located at the distal end in the form of a slot 50 for engaging tab 44. The combination of the support panels, bracing panel and elevating panel are referred to herein as a panel set, or bottom panel set. As is well known in the industry, the aforementioned flexible linkages do not necessarily mean that the panels are separate structures (they are usually contiguous with the remaining structure as shown in FIG. 11); for convenience, these panels are shown as discrete elements to facilitate understanding of the invention.

Figure 7:
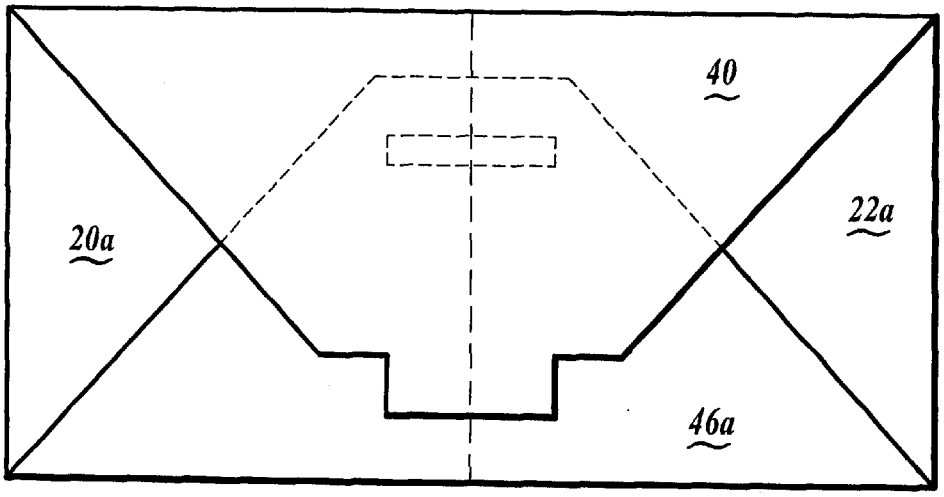
FIG. 7 is a plan view of the bottom of the container of FIG. 1 with the bottom panels, of FIGS. 4, 5 and 6, set in their unbiased position.
Figure 8:
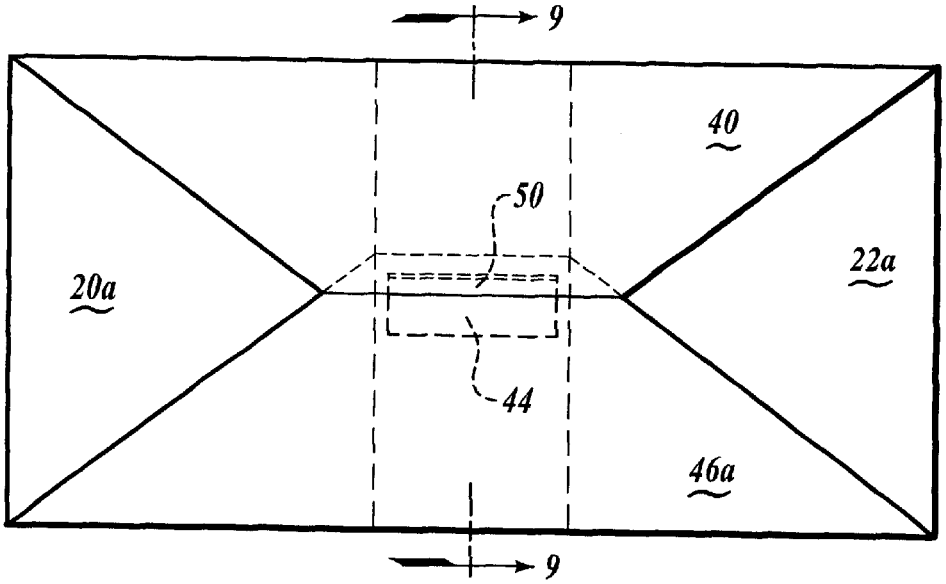
FIG. 8 shows a bottom plan view of the container of FIG. 2 with the bottom panels of FIGS. 4, 5 and 6 in the elevated and braced position.
Figure 9:
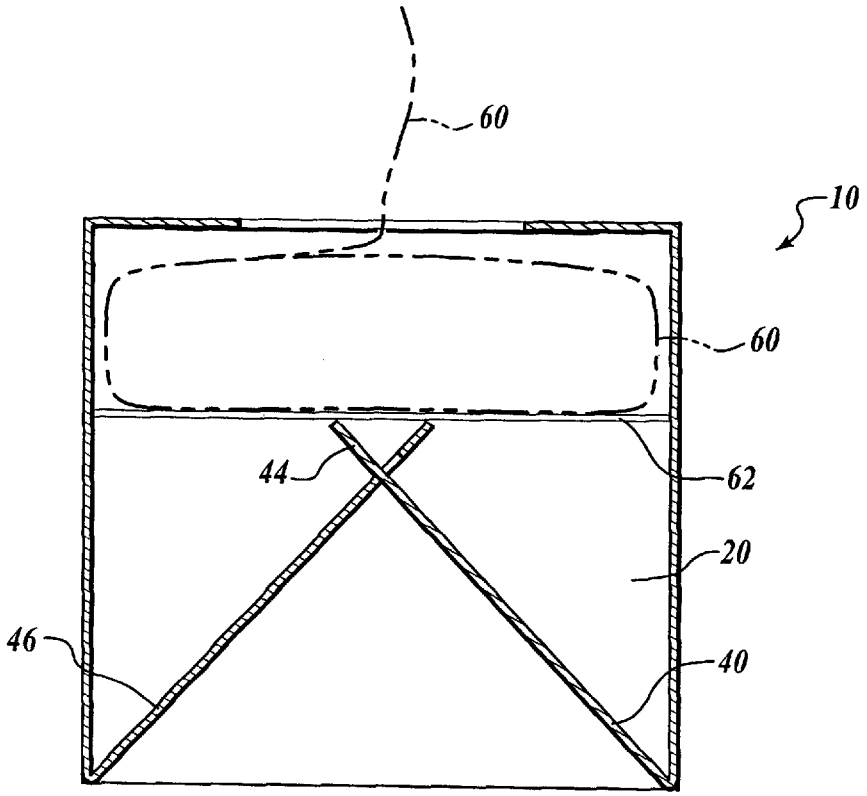
FIG. 9 depicts a cutaway end elevation of the container illustrated in FIG. 2, showing the position of the bottom panel set when elevated and braced upwardly.
Figure 10:
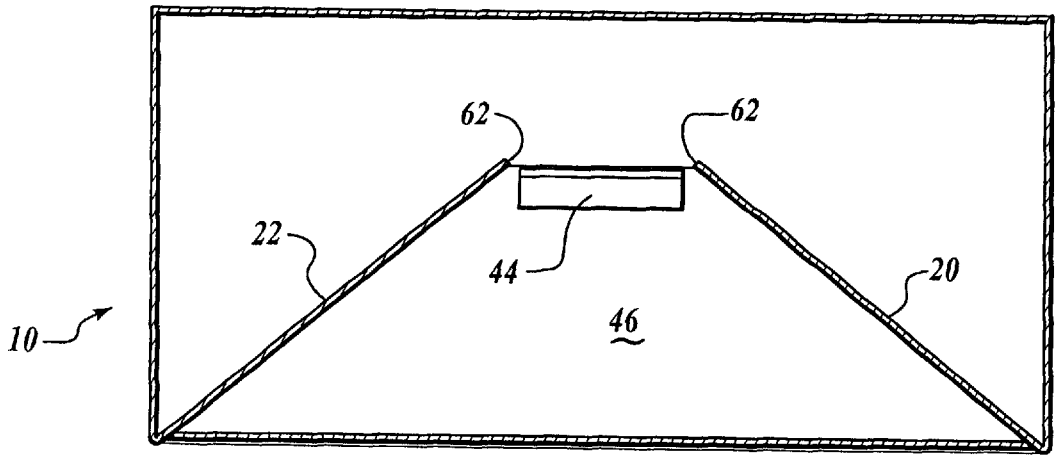
FIG. 10 depicts a cutaway side elevation of the container shown in FIG. 2, again showing the position of the bottom panel set when elevated and braced upwardly.

When the container 8 is initially manufactured, the support panels 20 and 22 are folded perpendicular to the sides of the box with only a portion of the bottom facing surfaces 20*a* and 22*a* exposed as is best shown in FIG. 7. Elevating panel 46 is folded up next to the support panels 20 and 22 with a portion of its bottom facing surface 46*a* exposed. Bracing panel 40 is the outer most of the bottom panel set. Bracing panel 40 and elevating panel 46 are releasably fastened together such as by an adhesive, tape, or other means that will permit separation of the two panels with a relatively minor separating force, such as may be easily applied by a person of average dexterity and strength. The tissues, or other sheet materials, are contained within the container 8 so manufactured and pulled individually through the dispensing slot 14. When the use of the contents of the container has lowered the level of the contents such that a leading tissue or sheet no longer remains held or disposed in the dispensing slot 14, then the elevating floor aspect of the invention is employed. First the bracing panel 40 and elevating panel 46 are separated from one another as described above. Then the two panels are biased generally in an upward direction towards the dispensing slot 14 until the tab 44 engages the slot 50. FIG. 8 is a bottom view of the panels in their raised positions with the tab 44 engaged in slot 50. Once the tab 44 is engaged in the slot 50, the elevated panel is in effect braced, or locked, in the upward position. FIG. 9 illustrates the bracing panel 40 and elevating panel 46 in the braced position from generally an end view of the container. As panels 40 and 46 are being biased upwardly generally towards the dispensing slot 14, support panels 20 and 22 are urged, or elevated, upwardly as well. FIG. 10 is a side view of the panel set in an upwardly urged position. Reference 60, in FIGS. 9 and 10, indicates the approximate outline of a clip of tissues resting on distal edges 62 of support panels 20 and 22, and a single tissue extending from the clip through the top of the container.

Figure 11:
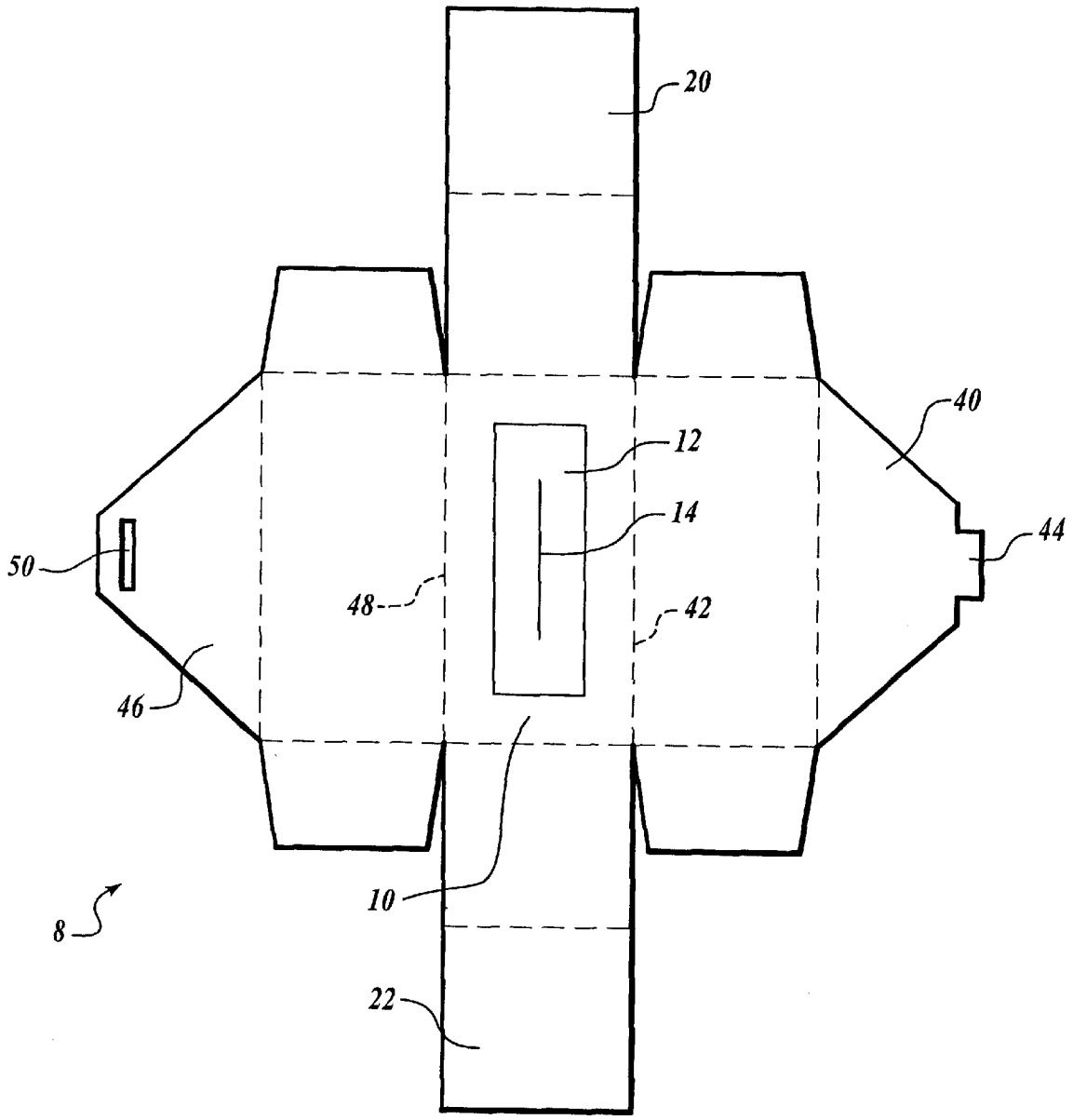
FIG. 11 is a plan view of the entire cutout of the container before it is folded and assembled.

FIG. 11 is a view of the container 8 material prior to folding and adhering the various panels and parts together to complete the container. Such a container is referred to as being of unitary construction. However, the container may be manufactured from discrete elements as well.

Figure 12:
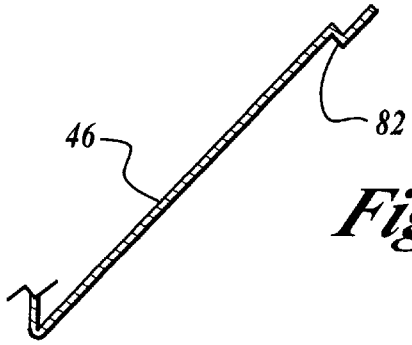
FIG. 12 is a plan view of the bracing panel with an engagement edge.
Figure 13:
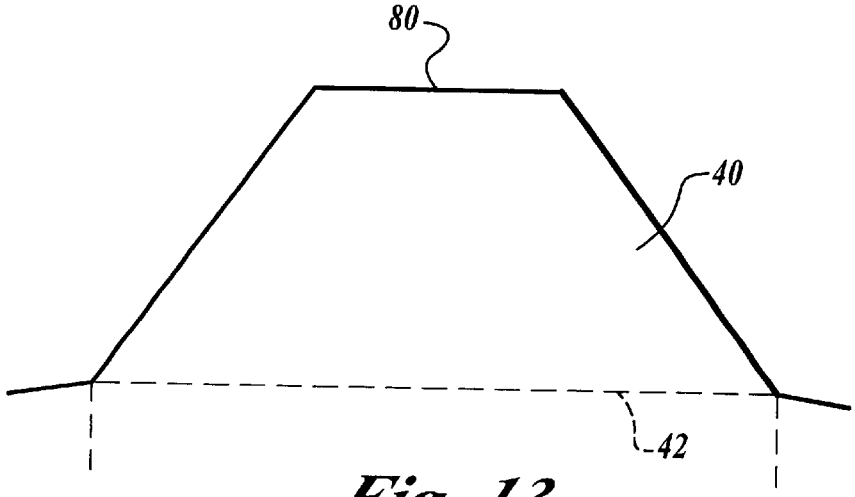
FIG. 13 is an edge-wise elevation of the elevating panel with an engagement fold.
Figure 14:
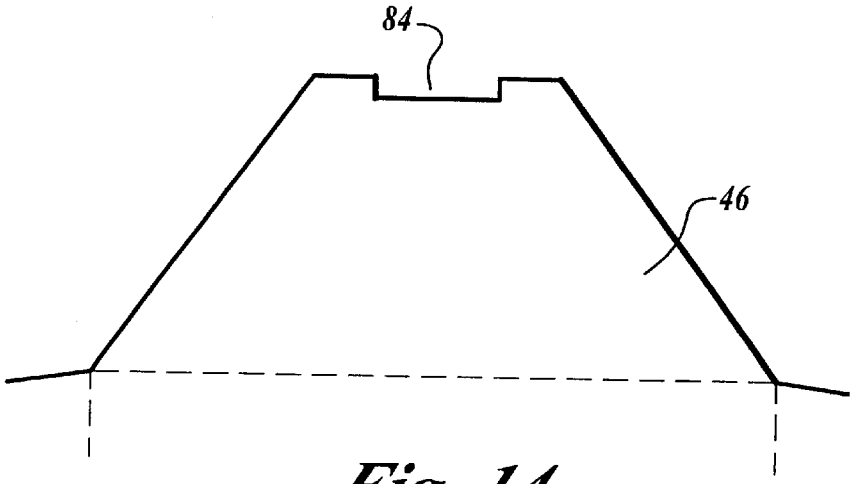
FIG. 14 is a plan view of the elevating panel with an engagement notch.

Alternative embodiments are readily adaptable to this invention. For instance, the engaging means on the bracing panel need not be a tab. FIG. 12 illustrates an engagement edge 80 of bracing panel 40. The engagement edge 80 is adaptable to engage an engagement fold 82 in the elevating panel 46 as shown in an edge view in FIG. 13. FIG. 14 illustrates an alternative engaging means of the elevating panel 46 in the form of a notch 84 for engaging tab 44, instead of the slot 50 disclosed above. Various other forms of engagement means are useful in this invention, including glue, fasteners, clips of various shapes, creases and detents. The principal function of the engagement means being, to hold the elevating panel in a braced elevated position once biased upwardly. Other engagement means are well known in the art.

Figure 15:
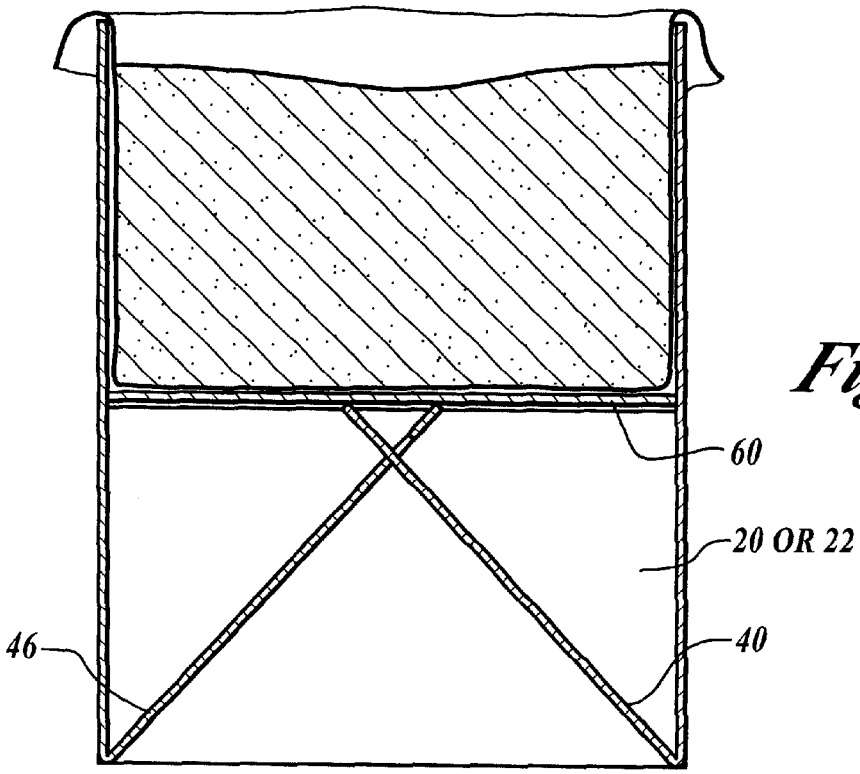
FIG. 15 depicts an alternative embodiment with a floating panel.

Another embodiment of the invention includes the bottom panel set as described above, but adds a floating panel 90 as shown in FIG. 15. The operation of the container and the bottom panel set is the same as described above. The addition of floating panel 90 is useful in a container of loose bulk products. Floating panel 90 is manufactured to just fit the interior dimensions of the container, so that, as it is elevated when bottom panel set is biased upwardly, it raises the product resting on its upper surface to a more convenient level. The floating panel 90 may simply rest atop the other panels of the panel set, or it may include a form of attachment to the panels below it to aid in keeping the floating panel level.

Figure 16:
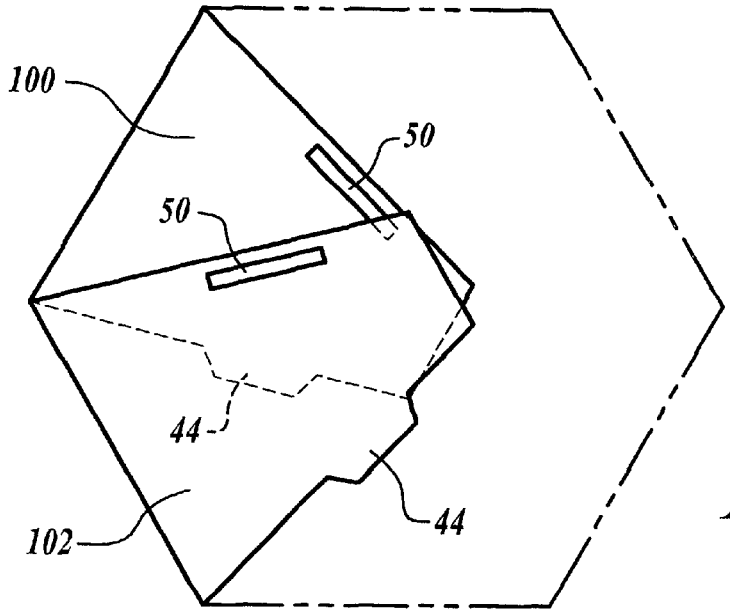
FIG. 16 depicts an alternative embodiment with overlapping panels.

A further embodiment of the present invention is disclosed in FIG. 16. Depicted in FIG. 16 is a portion of a six-sided container as viewed from the bottom. Only two panels, 100 and 102, of a plurality of overlapping panels comprising a bottom panel set are shown. Each panel is essentially identical, each having a tab 44, and a slot 50. As the bottom panels are biased upwardly, the tab of one panel engages in the slot of an adjacent panel. Alternative means for engaging the panels as previously discussed are applicable in this configuration as well. The container need not be restricted to six sides. A container having three (3) or more sides, or even generally a cylindrical form is adaptable to the present invention. The floating panel embodiment discussed above is also suitable to this type of bottom panel set arrangement.

Lastly, it is noted that elevation of the bottom panels of a container having the present invention may be facilitated by inverting the container so as to reduce the downward force present on the bottom panel set. This may be especially desirable when a floating panel is being used; asymmetrical loading of the floating panel is avoided if substantially all forces are removed by inverting the container.

We claim:

1. An improved facial tissue dispensing container with an elevatable floor, the container having a top portion defining an aperture for receiving at least one facial tissue, at least one side wall portion contacting the top portion, and a floor portion contacting the at least one side wall portion, the floor portion comprising:

at least one elevating panel having a proximal end and a distal end including a first engagement means for holding the at least one elevating panel in a braced position wherein the elevating panel is flexibly linked to the at least one side wall portion at the proximal end; and at least one bracing panel having a proximal end and a distal end including a second engagement means for holding the at least one bracing panel in a braced position wherein the bracing panel is flexibly linked to the at least one side wall portion at the proximal end, and wherein the elevating panel and the bracing panel are in a partially overlapping relationship prior to elevation such that, when the elevating and bracing panels are biased generally towards the top portion of the container, the first and second engagement means directly interact to form a braced position, thereby bracing the elevating panel in an upward position and supporting facial tissues stored therein at a level closer towards the top portion.

2. The container of claim 1 further comprising at least one support panel having a proximal end and a distal end wherein the support panel is flexibly linked to the at least one side wall portion at the proximal end, and is positioned proximate to and above the elevating and bracing panels prior to elevation, whereby when the elevating and bracing panels are biased towards the top portion of the container and into the braced position, the distal end of the support panel is urged toward the top portion.

3. The container of claim 1 wherein the container has four side wall portions, thus forming a box-type structure, and the first and second engaging means are selected from the group consisting of a tab, a slot, an edge, a fold, a crease and a detent.

4. The container of claim 2 further comprising two support panels, generally positioned opposite to one another.

5. The container of claim 1 wherein the bracing panel and the elevating panel have a substantially frusto-triangular geometric shape.

6. The container of claim 1 wherein a plurality of side wall portions contact the top portion, and the total number of elevating panels and bracing panels is equal to the total number of side wall portions.

7. The container of claim 1 further comprising a floating panel disposed between the elevating and bracing panels, and the top portion.

8. The container of claim 1 comprising a plurality of tissues disposed in a space defined by the top portion, the bottom portion, and the at least one side wall portion.

9. An improved material storage container comprising:

a plurality of rectilinear side panels;

a plurality of bottom panels each having a proximal end flexibly linked to a side panel and distal end having a first engagement means for holding the bottom panel in a braced position and a second engagement means for holding the bottom panel in a braced position, wherein each bottom panel partially overlaps at least one adjacent bottom panel, and a top portion contacting each of the plurality of side panels at an upper portion thereof such that, when the plurality of bottom panels are urged toward an inside face of the side panels, the first engagement means of each panel directly engages the second engagement means of an adjacent panel to form a braced position, thus effectively bracing the plurality of bottom panels in a generally upward position.

10. The material storage container of claim 9 wherein the first and second engagement means are selected from the group consisting of an edge and a fold, a tab and a slot, a tab and a notch, and an edge and a detent.

11. The material storage container of claim 9 wherein the first engagement means is located adjacent to a first edge and the second engagement means is located at a second edge that is generally opposite the first edge.

12. The material storage container of claim 9 further comprising a floating panel.

13. An improved facial tissue dispensing container with an elevatable floor, the container having a top defining an aperture for receiving at least one facial tissue; first, second, third and fourth side walls contacting the top portion; and a floor contacting the side walls, the floor comprising:

an elevating panel having a proximal end and a distal end defining a slot wherein the elevating panel is flexibly linked to the first side wall at the proximal end; and a bracing panel having a proximal end and a distal end forming a tab wherein the bracing panel is flexibly linked to the second side wall at the proximal end, and wherein the elevating panel and the bracing panel are in a partially overlapping relationship prior to elevation such that the slot receives the tab to form a braced position when the elevating and bracing panels are biased generally towards the top of the container, thereby bracing the elevating panel in an upward position and supporting facial tissues stored therein at a level closer towards the top.

14. The container of claim 13 further comprising a first support panel and a second support panel, each having a proximal end and distal end wherein the first support panel is linked to the third side wall at its proximal end and the second support panel is linked to the fourth side wall at its proximal end and each is positioned proximate to and over the elevating and bracing panels prior to upwardly biasing the floor to raise tissues disposed in the container.

15. The container of claim 14 wherein the bracing panel and the elevating panel have a substantially frusto-triangular geometric shape and the base of the shape corresponds to the proximal end.

16. The container of claim 15 further comprising a floating panel.

* * * * *